US006283734B1

(12) United States Patent
Blume

(10) Patent No.: US 6,283,734 B1
(45) **Date of Patent: *Sep. 4, 2001**

(54) GEAR PUMP AND A METHOD FOR POSITIONING A GEAR PUMP SHAFT

(75) Inventor: Peter Blume, Zurich (CH)

(73) Assignee: Maag Pump Systems Textron AG, Zurich (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/219,305

(22) Filed: Dec. 23, 1998

(30) Foreign Application Priority Data

Dec. 23, 1997 (CH) ..... 2959/97

(51) Int. Cl.[7] ..... F04C 2/18

(52) U.S. Cl. ..... 418/1; 418/15; 418/178; 418/179; 418/206.1; 418/206.4; 418/206.9

(58) Field of Search ..... 418/1, 15, 178, 418/179, 206.1, 206.4, 206.7, 206.9

(56) References Cited

U.S. PATENT DOCUMENTS

| | | | | |
|---|---|---|---|---|
| 1,923,268 | * | 8/1933 | Jensen | 418/206.1 |
| 2,228,933 | * | 1/1941 | Thomson | 418/15 |
| 2,626,570 | | 1/1953 | Armington et al. | 418/74 |
| 3,023,706 | * | 3/1962 | De Fezzy et al. | 418/206.1 |
| 3,077,840 | * | 2/1963 | Wood | 418/179 |
| 3,286,643 | | 11/1966 | Andrews et al. | 418/78 |
| 3,704,968 | * | 12/1972 | Haupt | 418/178 |
| 3,881,849 | * | 5/1975 | Commarmot et al. | 418/206.1 |
| 4,137,023 | * | 1/1979 | Moked et al. | 418/178 |
| 4,682,939 | * | 7/1987 | Petro | 418/178 |
| 4,744,738 | * | 5/1988 | Miki et al. | 418/178 |
| 5,044,908 | * | 9/1991 | Kawade | 418/179 |
| 5,388,974 | * | 2/1995 | Streiff | 418/206.4 |

FOREIGN PATENT DOCUMENTS

| | | | | |
|---|---|---|---|---|
| DE323573 | | 4/1918 | (DE) . | |
| 197 25 462 A1 | | 12/1998 | (DE) . | |
| EP0064239A1 | | 11/1982 | (EP) . | |
| FR2163935 | | 7/1973 | (FR) . | |
| 504059 | * | 4/1939 | (GB) | 418/179 |
| GB2138074A | | 10/1984 | (GB) . | |
| 317496 | * | 5/1934 | (IT) | 418/206 |
| 63-29082 | * | 2/1988 | (JP) | 418/179 |

* cited by examiner

*Primary Examiner*—John J. Vrablik
(74) *Attorney, Agent, or Firm*—Crowell & Moring LLP

(57) ABSTRACT

A gear pump for delivering liquid media has a pump housing with at least two bores, in which at least two meshing gears with tooth tips are contained. The gears are radially mounted by bearing surfaces which on one side consist of areas of the tooth tips and on the other side, of areas of the interior of the bores. This arrangement requires no slide bearings in the conventional sense, which results in a smaller number of pump parts and hence to reduced manufacturing costs.

28 Claims, 4 Drawing Sheets

GEAR PUMP AND A METHOD FOR POSITIONING A GEAR PUMP SHAFT

BACKGROUND AND SUMMARY OF THE INVENTION

This application claims the priority of application 1997 2959/97, filed in Switzerland on Dec. 23, 1997, the disclosure of which is expressly incorporated by reference herein.

The present invention relates to a gear pump and a method for positioning a gear pump shaft.

Gear pumps of the simplest design consist of a pair of gears that are the same size and mesh with one another, said gears being surrounded on all sides by a housing. The gears are mounted on two shafts mounted in the housing, one of said shafts, once again the simplest design, being guided to the outside through a shaft seal as a drive shaft. On both sides of the tooth engagement, the housing has an opening for admitting and discharging the pumping medium. When the gears rotate, the tooth spaces that disengage fill with the pumping medium flowing in, which is then delivered to the pressure side along the housing walls. At that point, it is compressed by the teeth which then again engage in the spaces, compressing the medium, and forcing it through the outlet opening into a pressure line.

Gear pumps represent proven pressure-developing systems with a high volumetric efficiency. Therefore, the forces acting on the gears and thus on the shafts carrying the gears are correspondingly high and must be accepted in known fashion by corresponding slide bearings. The slide bearings are traversed by the pumping medium and lubricated thereby. According to bearing theory, the shafts float in the bearings when the operating conditions are correctly chosen, so that the bearing load and the bearing carrying capacity are in equilibrium.

A known gear pump is described for example in patent publication EP-0 753 678.

However, the known design for gear pumps suffers from the disadvantage that these gear pumps depend on the rheological and thermal boundary values of the pumping medium. In other words gear pumps must be designed on the basis of the pumping medium.

The present invention therefore has a goal of providing a method and/or a gear pump in which the above mentioned disadvantages do not occur.

This goal is achieved according to preferred embodiments of the invention by producing an arrangement wherein the radial positioning of the gears takes place by means of the tooth tips and the interiors of the bores in the pump housing.

Advantageous embodiments of the invention including gear pumps and shaft positioning methods are described in the following specification and claims.

The invention has the following advantages: while the radial positioning of the gears is performed by the tooth tips and the insides of the housing bores, a decoupling of the operating conditions from the properties of the pumping medium is achieved, at least any residual attendance of the operating conditions on the flow behavior of the pumping medium is slight. Accordingly, the manufacturing costs for gear pumps according to the invention can be reduced significantly. Since the gears are supported over the entire width of the tooth, shaft deformations are completely eliminated in this new gear pump. This also includes the advantage that the play can be much smaller when the drive shaft passes through the shaft feedthrough.

In addition, the elimination of conventional slide bearings significantly reduces the number of parts required, reduces the housing dimensions, and simplifies the design of the housing overall. In this way, the axial play in particular is less than in known gear pumps, which means that a higher efficiency and hence lower losses are obtained with the gear pump according to the invention.

Other objects, advantages and novel features of the present invention will become apparent from the following detailed description of the invention when considered in conjunction with the accompanying drawings.

DETAILED DESCRIPTION OF THE DRAWINGS

Figure 1:
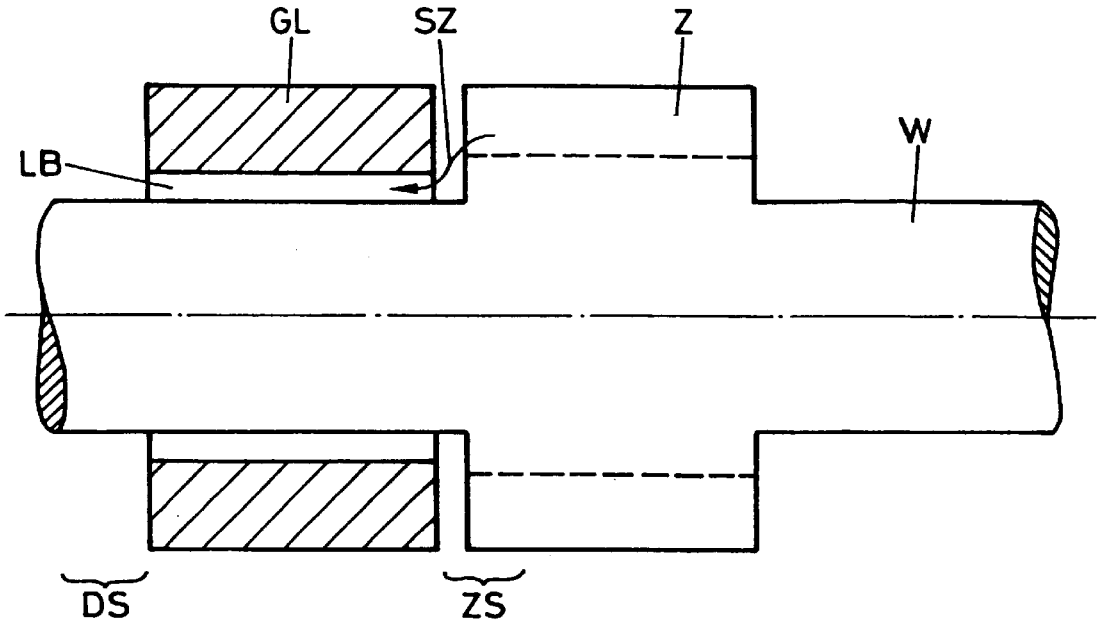
FIG. 1 PRIOR ART
FIG. 1 is a schematic sectional view which shows a shaft of a known sear pump introduced into a slide bearing.

FIG. 1 shows, as parts of a known gear pump, a slide bearing GL with a bearing bore LB, in which a shaft W is mounted, with shaft W bearing a gear Z that meshes with a second gear (not shown). A pumping medium that is delivered by the gear pump, namely in the tooth spaces of gear Z, is fed from an inlet opening (also referred to as the suction side) to the outlet opening (also referred to as the pressure side). Because of the prevailing pressure conditions, the pumping medium moves from the tooth spaces in the bearing area in the direction of arrow SZ shown in FIG. 1, in other words the pumping medium flows in slide bearing GL from the gear side ZS to the seal side DS. As this latter term expresses, a seal is required downstream from slide bearing GL in the direction of gear Z (not shown in FIG. 1), so that an indeterminate amount of pumping material can flow away through slide bearing GL. In addition to slide bearing GL and the seals on the seal side DS, additional measures are required to ensure sufficient lubrication of slide bearings GL. Thus it should be noted that the pumping medium that flows into slide bearing GL is constantly replaced. For this purpose, it is known to provide a relief channel that connects an intermediate space between the slide bearing and the seal with the suction side of the gear pump. For this purpose, the pumping medium flowing through slide bearing GL is transported back again to the inlet opening of the gear pump.

As another variation shows, it is known to carry away the pumping medium that escapes on the seal side from slide bearing GL and to use it in some other way or to dispose of it.

Both of the described versions of prior art pump arrangements involve significant structural expenditures that make themselves felt accordingly in the price.

Figure 2:
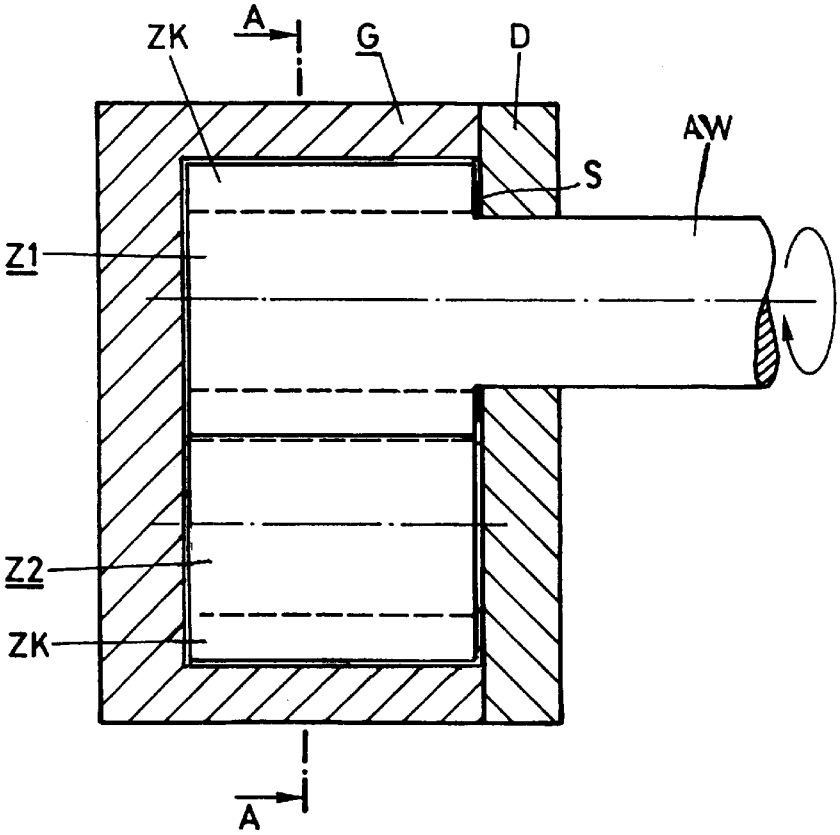
FIG. 2 shows a gear pump according to the invention with a two-part housing in a schematic representation.

FIG. 2 shows a gear pump according to the invention, which includes a housing G, a housing lid D, and two meshing gears Z1 and Z2. The first gear Z1 is mounted on a shaft AW in this embodiment or forming a pump component with the latter. Shaft AW and hence gear Z1 are driven by a motor (not shown). In this embodiment, the second gear Z2 is driven by the first gear Z1. In another contemplated embodiment, provision is made such that the first gear Z1 and the second gear Z2 are each driven by a separate motor. In this case, two shaft feedthroughs are provided in housing AG and in housing lid D, said feedthroughs of course also having to be sealed accordingly, with conventional seals being used for the purpose.

For the sake of completeness, it must be pointed out that as in the case of most known gear pumps, in the present gear pump according to the invention so-called squeeze grooves are provided. These are located in the corresponding housing lids or in the corresponding walls of the pump housing and permit pressure equalization in the area provided with teeth.

In contrast to the known gear pump according to FIG. 1, in the gear pump according to the invention no slide bearings are required. Positioning in the radial direction is accomplished according to the invention by the tooth tips and housing bores, in other words the bearing is located between the tooth tips and the housing bores that receive the gears.

Positioning in the axial direction is provided by a lid D and the composite housing wall. A schematically depicted shaft seal S at the lid D can also be provided and used to axially support the one gear. Instead of a housing bore as shown in FIG. 2, into which gears Z1 and Z2 can be inserted, embodiments with a through bore are also contemplated, with two lids D, namely one at each end, being provided. As a result, the pump housing consists of a total of three parts, which corresponds to the preferred embodiment of FIG. 3.

Figure 3:
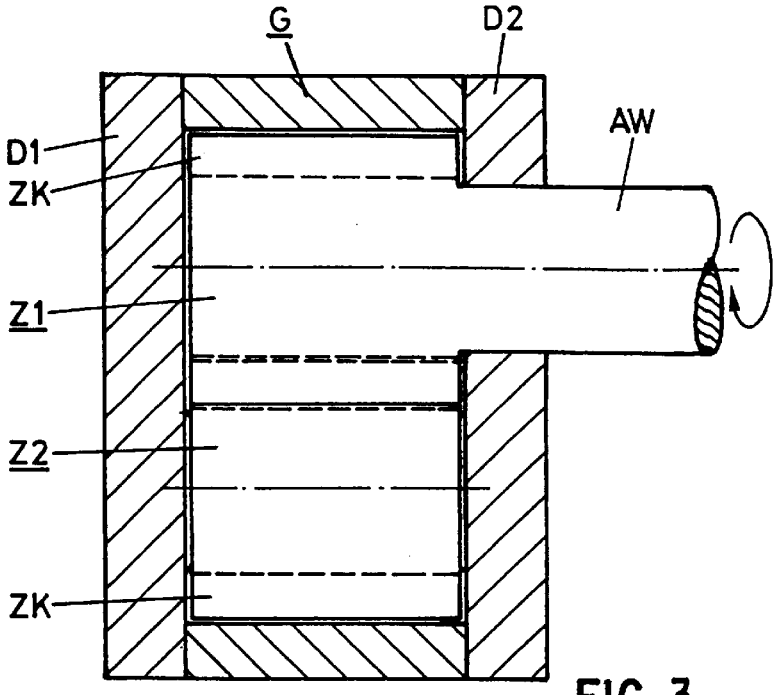
FIG. 3 shows a gear pump according to the invention with a three-part housing in a schematic representation.

FIG. 3 shows a gear pump with a three-part pump housing of this kind, with the housing G that receives gears Z1 and Z2 being provided endwise with lids D1 and D2, respectively.

Figure 4:
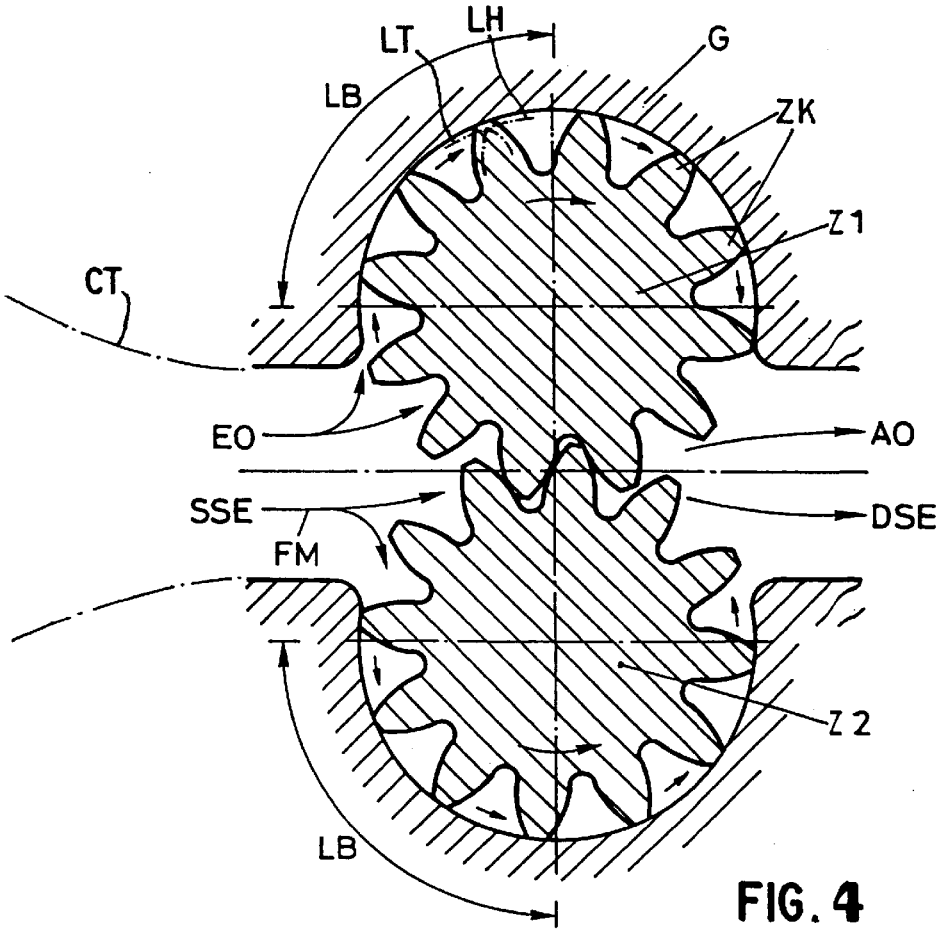
FIG. 4 shows a section along 4—4 through the gear pump according to the invention shown in FIG. 2.

FIG. 4 shows a partial cross-section along sectioning plane A—A through the gear pump shown in FIG. 2 according to the invention. In this cross section, inlet and outlet openings EO and AO, respectively can be seen for pumping medium FM, as well as gears Z1 and Z2 with their tooth tips ZK, and in part, housing G of the gear pump according to the invention. As already mentioned, the radial positioning of gears Z1 and Z2 is performed by means of their tooth tips ZK and housing G. As a result of the distribution of forces in the steady operating state of the gear pump, sufficient lubrication is required especially in load areas LB, since in these load areas LB corresponding forces must be accepted by housing G.

Figure 6:
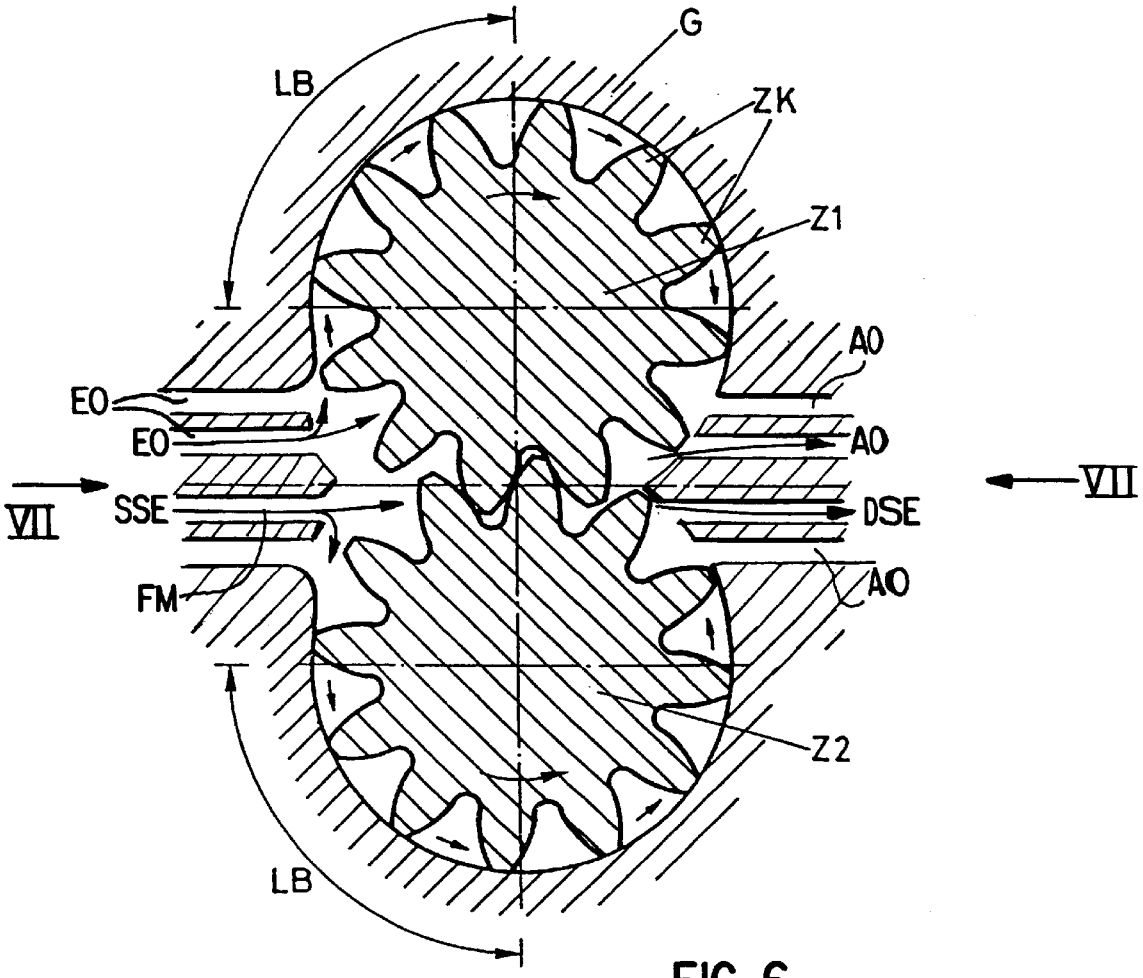
FIG. 6 is a view similar to FIG. 4, showing embodiments including plural inlet and outlet openings.
Figure 7:
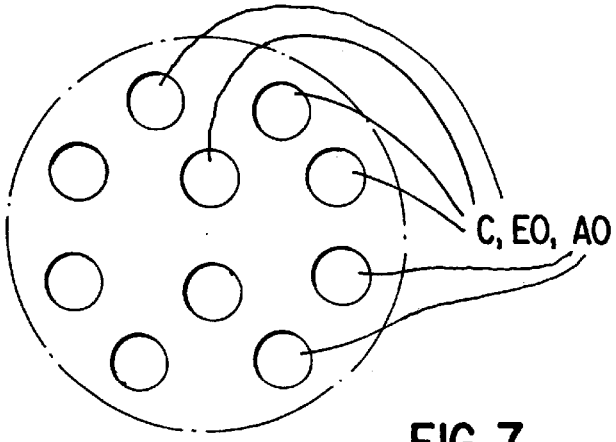
FIG. 7 is a schematic view taken in the direction of one of the respective arrows VII of FIG. 6.

It is evident from FIG. 4 that an inlet and an outlet bore are provided for pumping medium FM which are essentially perpendicular to the lengthwise axes of gears Z1 and Z2. A schematically depicted conical supplied tube CT leads to the inlet. An embodiment is also contemplated that is even advantageous with respect to the version described above in which two or more inlet and/or outlet openings are provided for pumping medium FM, since in such an embodiment there is the possibility that tooth tips ZK can also be supported in the vicinity of the inlet and outlet openings. This embodiment has the particular advantage that the edges of the inlet opening are relieved of a load. FIG. 6 is similar to FIG. 4, showing such alternative embodiments with plural inlet and outlet openings EO and AO. FIG. 7 schematically shows the pattern of openings.

In another embodiment of the invention, the pumping medium is supplied and/or carried away endwise relative to the gears. As a result there is the basic possibility of being able to support the tooth tips equally on all sides. The inlet and/or outlet opening or the associated inlet and outlet bores in this embodiment expand essentially parallel to the gear axes.

Figure 5A:
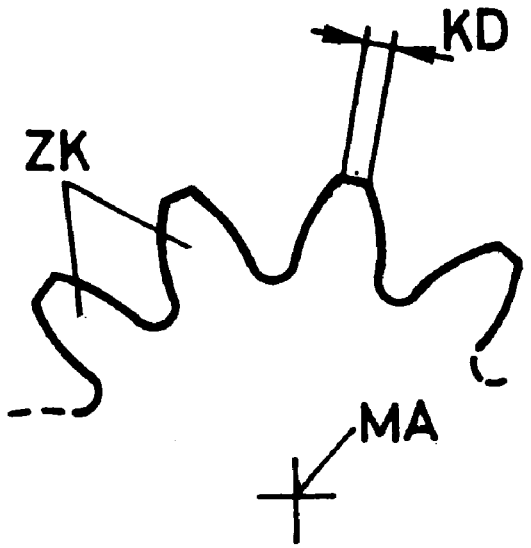
FIG. 5A PRIOR ART
FIG. 5A shows an embodiment of tooth tips in a known gear pump.
Figure 5B:
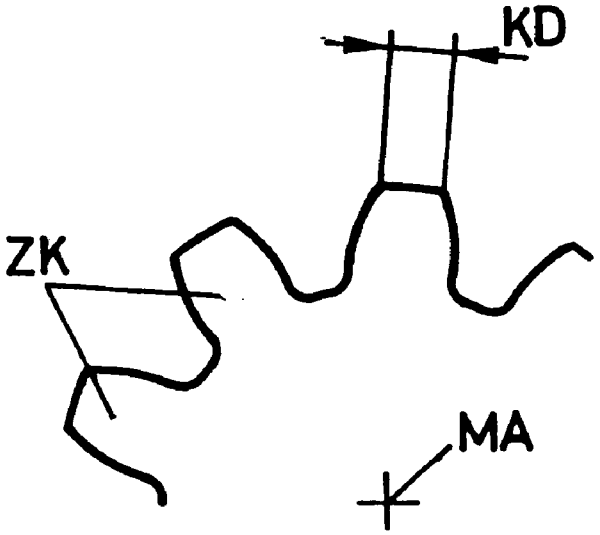
FIG. 5B shows tooth tips in a gear pump according to preferred embodiments of the invention

In FIGS. 5A and 5B, gears are shown partially. FIG. 5A shows a known embodiment, assuming that slide bearings are provided for the shaft. FIG. 5B shows an embodiment according to the invention, in a section perpendicular to the central axis MA of that gear. As is known, in conventional gear pumps, slide bearings are used to hold the gears in position. In the gear pumps according to the invention, positioning is performed as mentioned above by tooth tips ZK sliding on the interior of the housing bore.

It has been found that the known arrangement of tooth tips ZK according to FIG. 5A can be used to produce the invention, provided the pressure differential between the pressure and suction sides of the gear pump is not excessively high or if an especially hard material is used for the tooth tips ZK and the housing parts that are subjected to stress.

In an improvement on the invention it is proposed to increase the tooth tip width KD so that the sliding area per tooth can be increased. This is shown in FIG. 5B. Accordingly, gear pumps so designed can be used with a higher required pressure differential between the intake and pressure sides. If a material that is extremely resistant is used for tooth tips ZK and/or for the housing parts that are subjected to stress by positioning, gear pumps that are so designed are characterized by a wide range of applications.

In preferred embodiments of the invention, the tooth tip width KD is such that the sum of all the tooth tip widths is between 5% and 20% of the tooth tip circle circumference, where the tooth tip circle circumference is the circle having a radius from MA to the center of the tooth tip. In especially preferred embodiments the sum of all the tooth tip widths is between 5% and 15% of the tooth tip circumference.

The width KD of the tooth tips is selected according to the invention to provide sufficient area for carrying out the bearing function, while take into consideration that smaller tooth widths KD improve the friction resistance conditions of the operating gear pump.

Since resistant materials are expensive, it is proposed that instead of using a solid design, that the parts subjected to heavy stress be covered with a protective layer of the resistant material (so-called coating). Coating layers LT for the teeth and LH for the housing are schematic ally depicted in FIG. 4.

Finally, in a preferred additional embodiment, the pump parts, in other words the housing, lids, and gears, are made of materials that have essentially the same coefficient of thermal expansion (so-called alpha values) that are preferably identical.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Gear pump comprising:

a pump housing forming a plurality of pump housing bores, a gear disposed in each of said bores and having gear tooth tips which intermesh with gear tooth tips of at least one other of said gears during pumping operation with said gears rotating about respective gear longitudinal axes, an inlet opening into said housing operable to supply medium to be pumped, and an outlet leading from said housing and operable to guide pumped medium out of the housing, wherein at least one of said inlet and outlet includes a plurality of openings separated by support structure, wherein the at least one of said gears is supported on a driven shaft, wherein said driven shaft has no radial bearing support at said pump housing, and wherein the gears are radially supported in the housing with bearing surfaces formed by areas of facing tooth tips of the gears and with bearing surfaces formed by housing interior surfaces forming the bores and by the support structure separating the plurality of openings.

2. Gear pump comprising:

a pump housing forming a plurality of pump housing bores, a gear disposed in each of said bores and having gear tooth tips which intermesh with gear tooth tips of at least one other of said gears during pumping operation with said gears rotating about respective gear longitudinal axes, inlet means opening into said housing in a direction substantially perpendicular to the gear longitudinal axes and operable to supply medium to be pumped, outlet means leading from said housing in a direction aligned with the inlet means and substantially perpendicular to the gear longitudinal axes and operable to guide pumped medium out of the housing, wherein at least one of said inlet and outlet means includes a plurality of openings separated by support structure, and wherein the shafts of the gears have no bearing support at the housing, said gears being supported in the housing with bearing surfaces formed by areas of facing tooth tips of the gears and with bearing surfaces formed by housing interior surfaces forming the bores and by the support structure separating the plurality of openings.

3. Gear pump according to claim 2, wherein an extremely resistant material is used for the bearing surfaces on at least one of the tooth tips and the pump housing, with heavily stressed areas in use preferably being covered by a layer of said resistant material.

4. Gear pump according to claim 2, wherein a supply tube is connected with the inlet means, said supply tube being made conical.

5. Gear pump according to claim 2, wherein the pump housing and the gears consist of materials that have coefficients of thermal expansion that are essentially identical.

6. Gear pump according to claim 2, wherein the outlet means includes a plurality of outlet openings separated by respective support structure.

7. Gear pump according to claim 2, wherein axial support of said gears takes place by at least one of a housing lid and a shaft seal.

8. Gear pump according to claim 2, wherein the pump housing and the gears consist of materials that have coefficients of thermal expansion that are essentially identical.

9. Gear pump according to claim 2, wherein the gears are axially mounted in the pump housing, with bearing surfaces on one side consisting of one of areas of the pump housing, areas of at least one housing lid, and of at least one shaft seal, and on the other side, of endwise areas of the gears.

10. Gear pump according to claim 9, wherein the tooth tips have respective extended tooth tip widths in a circumferential direction which provides for an increased bearing support area.

11. Gear pump according to claim 9, wherein an extremely resistant material is used for the bearing surfaces on at least one of the tooth tips and the pump housing, with heavily stressed areas in use preferably being covered by a layer of said resistant material.

12. Gear pump according to claim 2, wherein the tooth tips have respective extended tooth tip widths in a circumferential direction which provides for an increased bearing support area.

13. Gear pump according to claim 12, wherein an extremely resistant material is used for the bearing surfaces on at least one of the tooth tips the pump housing, with heavily stressed areas in use preferably being covered by a layer of said resistant material.

14. Gear pump according to claim 2, wherein the inlet means includes a plurality of inlet openings separated by respective support structure.

15. Gear pump according to claim 14, wherein the outlet means includes a plurality of outlet openings separated by respective support structure.

16. Gear pump according to claim 15, wherein the tooth tips have respective extended tooth tip widths in a circumferential direction which provides for an increased bearing support area.

17. Gear pump according to claim 15, wherein an extremely resistant material is used for the bearing surfaces on at least one of the tooth tips and the pump housing, with heavily stressed areas in use preferably being covered by a layer of said resistant material.

18. Gear pump comprising:

a pump housing forming a plurality of pump housing bores, a gear disposed in each of said bores and having gear tooth tips which intermesh with gear tooth tips of at least one other of said gears during pumping operation with said gears rotating about respective gear longitudinal axes, inlet means opening into said housing in a direction substantially perpendicular to the gear longitudinal axes and operable to supply medium to be pumped, outlet means leading from said housing in a direction aligned with the inlet means and substantially perpendicular to the gear longitudinal axes and operable to guide pumped medium out of the housing, wherein at least one of said inlet and outlet means includes a plurality of openings separated by support structure, wherein the gears are supported in the housing with bearing surfaces formed by areas of facing tooth tips of the gears and with bearing surfaces formed by housing interior surfaces forming the bores and by the support structure separating the plurality of openings, and wherein the outlet means includes a plurality of outlet openings separated by respective support structure.

19. Gear pump according to claim 18, wherein the tooth tips have respective extended tooth tip widths in a circumferential direction which provides for an increased bearing support area.

20. Gear pump according to claim 18, wherein an extremely resistant material is used for the bearing surfaces on at least one of the tooth tips and the pump housing, with heavily stressed areas in use preferably being covered by a layer of said resistant material.

21. Gear pump according to claim 18, wherein axial support of said gears takes place by at least one of a housing lid and a shaft seal.

22. A method for supporting gears in a gear pump of the type comprising:

a pump housing forming a plurality of pump housing bores, a gear disposed in each of said bores and having gear tooth tips which intermesh with gear tooth tips of at least one other of said gears during pumping operation with said gears rotating about respective gear longitudinal axes, an inlet opening into said housing operable to supply medium to be pumped, and an outlet leading from said housing and operable to guide pump ed medium out of the housing, wherein at least one of said inlet and outlet includes a plurality of openings separated by support structure, wherein the at least one of said gears is supported on a driven shaft, wherein at least one of said gears being supported on a shaft extending through an end wall of said housing, wherein said driven shaft has no radial bearing support at said pump housing, said method comprising supporting the gears radially in the housing with bearing surfaces formed by areas of facing tooth tips of the gears and with bearing surfaces formed by housing interior surfaces forming the bores and by the support structure separating the plurality of openings.

23. A method for supporting gears in a gear pump of the type comprising:

a pump housing forming a plurality of pump housing bores, a gear disposed in each of said bores and having gear tooth tips which intermesh with gear tooth tips of at least one other of said gears during pumping operation with said gears rotating about respective gear longitudinal axes, inlet means opening into said housing in a direction substantially perpendicular to the gear longitudinal axes and operable to supply medium to be pumped, and outlet means leading from said housing in a direction aligned with the inlet means and substantially perpendicular to the gear longitudinal axes and operable to guide pumped medium out of the housing, wherein at least one of said inlet and outlet means includes a plurality of openings separated by support structure, said method comprising supporting the gears in the housing with shafts of the gears having no bearing support and with bearing surfaces formed by areas of facing tooth tips of the gears and with bearing surfaces formed by housing interior surfaces forming the bores and by the support structure separating the plurality of openings.

24. A method according to claim 23, wherein the tooth tips have respective extended tooth tip widths in a circumferential direction which provides for an increased bearing support area.

25. A method according to claim 23, wherein an extremely resistant material is used for the bearing surfaces on at least one of the tooth tips and the pump housing, with heavily stressed areas in use preferably being covered by a layer of said resistant material.

26. A method according to claim 23, wherein a supply tube is connected with the inlet means, said supply tube being made conical.

27. A method according to claim 23, wherein the gears are axially mounted in the pump housing, with bearing surfaces on one side consisting of one of areas of the pump housing, areas of at least one housing lid, and of at least one shaft seal, and on the other side, of endwise areas of the gears.

28. A method according to claim 27, wherein the tooth tips have respective extended tooth tip widths in a circumferential direction which provides for an increased bearing support area.

* * * * *